US005426851A

United States Patent [19]

Gilder et al.

[11] Patent Number: 5,426,851

[45] Date of Patent: Jun. 27, 1995

[54] SAFETY RAZORS

[75] Inventors: Bernard Gilder, Twyford; Henry E. Bullen, Tilehurst, both of England

[73] Assignee: The Gillette Company, Boston, Mass.

[21] Appl. No.: 129,198

[22] PCT Filed: Mar. 24, 1992

[86] PCT No.: PCT/GB92/00539

§ 371 Date: Nov. 15, 1993

§ 102(e) Date: Nov. 15, 1993

[87] PCT Pub. No.: WO92/17322

PCT Pub. Date: Oct. 15, 1992

[30] Foreign Application Priority Data

Apr. 2, 1991 [GB] United Kingdom ..... 9106860

[51] Int. Cl.[6] ..... B26B 21/22

[52] U.S. Cl. ..... 30/50; 30/34.2

[58] Field of Search ..... 30/50, 34.2, 77, 346.5, 30/346.54, 32

[56] References Cited

U.S. PATENT DOCUMENTS

| | | | |
|---|---|---|---|
| 3,835,537 | 9/1974 | Sastri | 30/346.53 |
| 3,842,502 | 10/1974 | Hagan | 30/50 |
| 4,122,602 | 10/1978 | Sastri et al. | 30/346.5 |
| 4,200,976 | 5/1980 | Gooding | 30/47 |
| 4,272,885 | 6/1981 | Ferraro | 30/47 |
| 4,485,554 | 12/1984 | Bergamaschi | 30/50 |
| 4,621,424 | 11/1986 | Jacobson | 30/41 |
| 4,831,731 | 5/1989 | Eltis | 30/50 |
| 4,939,840 | 7/1990 | Butka | 30/37 |
| 5,067,238 | 11/1991 | Miller et al. | 30/34.002 |
| 5,142,785 | 9/1992 | Grewal et al. | 30/346.54 |
| 5,249,361 | 10/1993 | Apprille, Jr. et al. | 30/50 |

FOREIGN PATENT DOCUMENTS

| | | |
|---|---|---|
| 0336355 | 10/1989 | European Pat. Off. . |
| 2367580 | 10/1977 | France . |
| 2750796 | 5/1978 | Germany . |
| 714122 | 8/1954 | United Kingdom . |

*Primary Examiner*—Hwei Siu Payer
*Attorney, Agent, or Firm*—Donal B. Tobin

[57] ABSTRACT

A tandem blade razor with two continually sharpened blades and a third skin engaging member of planar form having a skin engaging edge with a tip radius of at least 0.5 microns. The rounded edge is positioned between the sharpened blade edges or behind them.

7 Claims, 1 Drawing Sheet

SAFETY RAZORS

This invention relates to safety razors for use in wet shaving, that is razors comprising one or more razor blades mounted in a head or frame including a guard member which limits the danger of the blade (or blades) deeply penetrating the skin of the user.

For many years, all razors which were marketed on a commercial scale incorporated a single blade, mostly of the "double-edged" type of which the edges could be used alternately. The early 1970's saw the introduction of blade cartridges comprising a pair of blade members having spaced, parallel cutting edges parallel with each other, so that they act in tandem upon the skin of the user. These "tandem blade cartridges" are now consumed in very large quantities in many countries.

It had long been predicted that the provision of a number of parallel blade edges would tend to increase the closeness and/or comfort in use of safety razors and this expectation has been fulfilled by the better quality tandem blade cartridges marketed in recent years.

It might accordingly be expected that a further improvement could be obtained by adding a third blade and trials conducted by the present Applicants have shown this to be the case.

However, the present invention is based on the surprising discovery that the results are even more satisfactory if the skin engaging edge of either the second or third member of a group of three tandem blades is rounded to such an extent that it will not penetrate facial hairs or scrape the skin. On the other hand, the edge should have a very narrow area of contact with the skin, so that the pressure which it applies is similar to that applied by the sharpened edges of the true blade members.

Most conveniently, the third member is substantially identical with the two blade members, being of the same general form and made of blade steel, but its skin engaging edge is formed with a relatively large radius. This edge is, however, electro-polished to give it a very smooth surface. The tip radius is preferably between 0.5 and 30 microns.

It would alternatively be possible to provide a third "blunted" member of quite a different form from the blade members and of another material, such as a relatively rigid plastics material.

Two forms of safety razor cartridge in accordance with the invention will now be described, by way of example, with reference to the accompanying drawings, in which.

Figure 1:
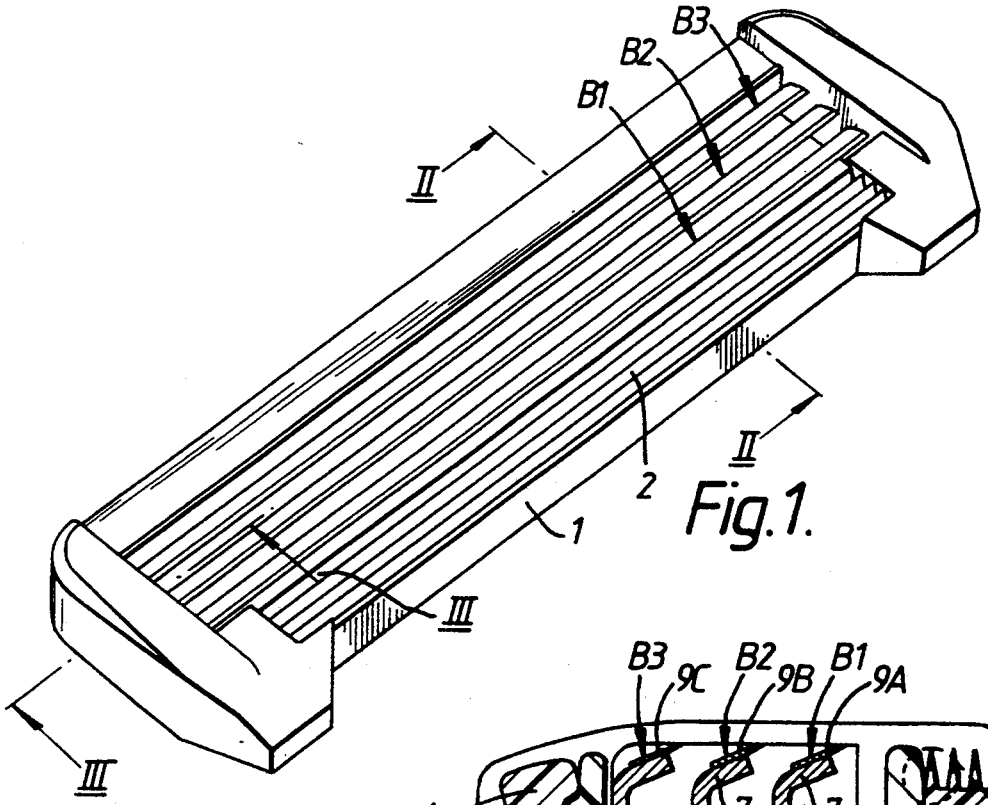
FIG. 1 is a perspective view of a first form of cartridge.
Figure 2:
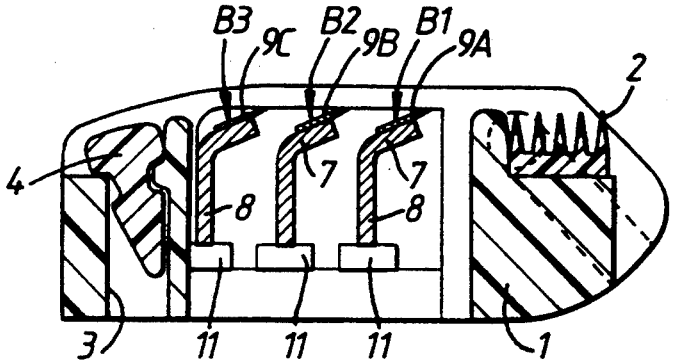
FIG. 2 is a cross-section taken at the line II—II in FIG. 1.
Figure 3:
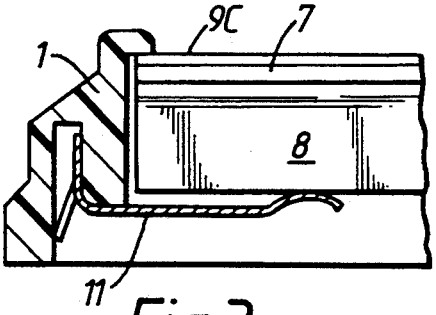
FIG. 3 is scrap cross-section taken in the line III—III in FIG. 1.

The cartridge shown in FIGS. 1 to 3 comprises a generally rectangular open frame 1 of moulded plastics, shaped to define a shoulder to receive and support a separately formed guard member 2 and a slot 3 to receive a separately formed cap member 4, preferably made of a lubricating strip.

Three substantially identical units B1, B2 and B3 are mounted in the frame 1, each comprising a metal support of inverted L-shape having an upwardly and forwardly directed limb constituting a blade platform 7 and a vertical support leg 8. The platform 7 has directly attached to it a respective member 9A, 9B, 9C of stainless steel razor blade strip. The three units are mounted for movement independently of each other in the planes of their legs 8 and are supported on respective spring fingers 11.

The member 9A of unit B1 and that of either B2 or B3 are conventionally sharpened at their forward, leading edges to form two blade members, but the third member (9C or 9B) (at either B3 or B2, respectively) is formed with a relatively blunt edge having an ultimate tip radius of at least 0.5 micron, so that it is not quite sharp enough to penetrate facial hairs, nor to scrape the skin. It is, however, electro-polished to have a very smooth surface finish. The third member could have a larger radius, up to about 50 microns but preferably no more than about 30 microns.

The third member may be incorporated in blade unit B2 or B3, but not in the leading blade unit B1.

Figure 4:
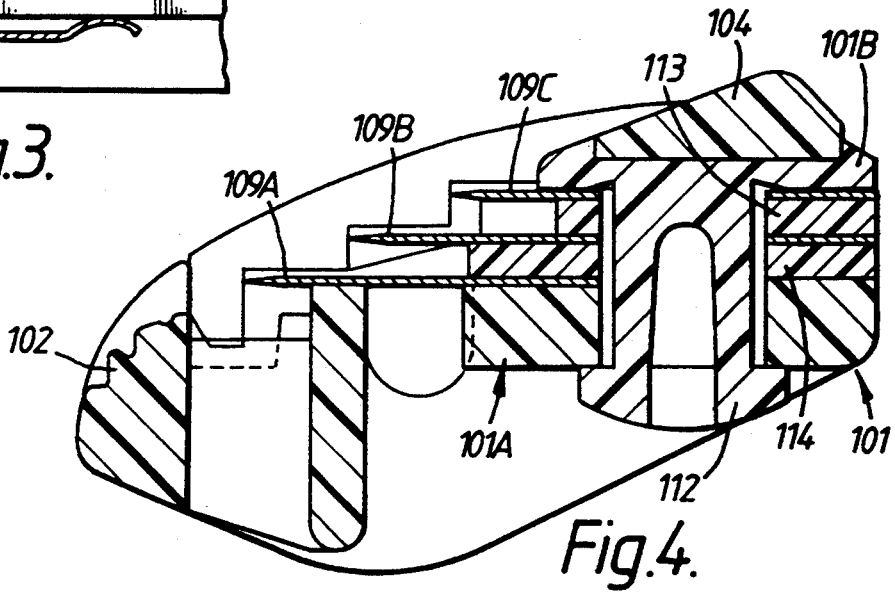
FIG. 4 is a cross-section, corresponding to FIG. 2, of a second form of razor cartridge.

The second form of cartridge, illustrated in FIG. 4, has a moulded frame 101 of more conventional form, comprising a first, lower moulding 101A having secured to it by entegral rivets 112 a second, upper moulding 101B which supports a cap member 104, preferably formed of lubricating strip. The lower moulding 101A provides a guard member 102. Securely and fixedly clamped between the mouldings 101A and 101B is an assembly of three members 109A, 109B, 109C and two spacers 113, 114.

Once again, the leading member (109A) and one of the others are conventionally sharpened, whilst the third (109B or 109C) has a relatively blunt edge, rounded to a radius of between 0.5 and 30 microns.

This second form of razor cartridge has been subjected to trials which have shown that, compared with a control cartridge having three conventional sharpened edges, significant improvements in comfort with no loss in closeness were obtained by use of the slightly blunted member in the second or third positions, i.e. at 109B or 109C. However, when the blunted member is placed in the leading position, at 109A, the closeness was significantly reduced.

It will be noted that in both embodiments described above, the three skin engaging edges are equally spaced from each other. They are all formed of blade steel and correspondingly shaped, except for the slight rounding of one member. This is convenient from a manufacturing viewpoint but it would also be possible to form the third member quite differently, say as a moulded member of relatively rigid plastics material.

Many other variations and modifications will, of course, be possible within the scope of the present invention.

We claim:

1. A safety razor cartridge comprising:

a guard disposed on a forward portion of said cartridge with respect to a direction of shaving;

a cap disposed on a rearward portion of said cartridge;

first and second blade members positioned between said guard and cap and each having a sharpened cutting edge, said cutting edges aligned parallel with each other; and, a skin engaging member (9B, 9C; 109B, 109C) of planar form and having a skin engaging edge parallel with the edges of said first and second blade members, said skin engaging edge having a tip radius of 0.5 to 50 microns and in that said skin engaging member (B2 or B3) is positioned rearwardly of the blade member (B1) closest to said guard.

2. A safety razor cartridge according to claim 1, wherein said tip radius is between 0.5 and 30 microns.

3. A safety razor cartridge according to claim 1, wherein said skin engaging member has the same form as the said blade members.

4. A safety razor cartridge according to claim 1, wherein said skin engaging member is made of metal.

5. A safety razor cartridge according to claim 4, wherein said skin engaging member (9B or 9C; 109B or 109C) is made of blade steel and has its skin engaging edge electro-polished.

6. A safety razor cartridge according to claim 1, wherein said skin engaging member (9B, 9C; 109B, 109C) is formed as a plastic moulding.

7. A safety razor cartridge according to claim 1 wherein the spacing among the three members is substantially equal.

* * * * *